US008901807B2

(12) United States Patent
Hao et al.

(10) Patent No.: US 8,901,807 B2
(45) Date of Patent: Dec. 2, 2014

(54) METAL GATE ELECTRODE AND FIELD EMISSION DISPLAY HAVING SAME

(75) Inventors: Hai-Yan Hao, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 134 days.

(21) Appl. No.: 13/174,881

(22) Filed: Jul. 1, 2011

(65) Prior Publication Data

US 2012/0049721 A1 Mar. 1, 2012

(30) Foreign Application Priority Data

Aug. 27, 2010 (CN) ..... 2010 1 0264754

(51) Int. Cl.
*H01J 1/62* (2006.01)
*H01J 29/46* (2006.01)
*H01J 31/12* (2006.01)

(52) U.S. Cl.
CPC ..... *H01J 29/467* (2013.01); *H01J 31/127* (2013.01); *H01J 2329/4617* (2013.01)
USPC ..... 313/497; 313/495

(58) Field of Classification Search
CPC ..... H01J 29/04; H01J 29/467; H01J 29/4604; H01J 29/4617; H01J 29/4621; H01J 29/4634; H01J 31/12; H01J 31/123; H01J 31/127
USPC ..... 313/495–497
See application file for complete search history.

(56) References Cited

U.S. PATENT DOCUMENTS

| | | | | |
|---|---|---|---|---|
| 6,553,096 | B1 * | 4/2003 | Zhou et al. | 378/122 |
| 8,350,459 | B2 | 1/2013 | Qian et al. | |
| 2002/0079802 | A1 * | 6/2002 | Inoue et al. | 313/309 |
| 2002/0167266 | A1 * | 11/2002 | Hirasawa et al. | 313/496 |
| 2004/0232823 | A1 * | 11/2004 | Nakata et al. | 313/495 |
| 2005/0116600 | A1 | 6/2005 | Chi et al. | |
| 2008/0061675 | A1 * | 3/2008 | Yotani et al. | 313/495 |
| 2009/0325452 | A1 * | 12/2009 | Nakano et al. | 445/50 |
| 2010/0019647 | A1 * | 1/2010 | Hao et al. | 313/329 |

FOREIGN PATENT DOCUMENTS

| | | |
|---|---|---|
| CN | 101083198 | 12/2007 |
| TW | 200926241 | 6/2009 |

* cited by examiner

*Primary Examiner* — Andrew Coughlin
(74) *Attorney, Agent, or Firm* — Novak Druce Connolly Bove + Quigg LLP

(57) ABSTRACT

A metal gate electrode for a field emission device includes a plurality of metal strips. Some of the metal strips are arranged substantially along a first direction, and other metal strips are arranged substantially along a second direction substantially perpendicular to the first direction. The metal strips are connected to each other to define a plurality of rectangular apertures through which electrons can pass.

15 Claims, 5 Drawing Sheets

METAL GATE ELECTRODE AND FIELD EMISSION DISPLAY HAVING SAME

BACKGROUND

1. Technical Field

The present disclosure relates to a metal gate electrode with a plurality of rectangular apertures allowing electrons to pass through, and a field emission display having the same.

2. Description of Related Art

Field emission display is an attractive flat panel display device because the field emission display does not need additional backlight. Therefore, the field emission display device has high brightness, low power consumption, and fast response speed.

A conventional triode field emission display generally comprises at least one anode, at least one cathode, and a gate electrode between the anode and the cathode. The gate electrode provides an electrical potential to extract electrons from the cathode. The anode provides an electrical potential to accelerate the extracted electrons to bombard the anode for luminance.

The above-mentioned gate electrode is fabricated by a photolithography process and a corrosion process. The metal mesh comprises a plurality of apertures through which electrons can pass. As the gate electrode is applied with electric signals, the electrons would extract from at least one tip of the cathode. The metal mesh made of conductive plates or conductive material is extensively applied for the triode field emission display because the manufacturing process for the metal mesh is simple.

However, the electrical potential provided by the anode may infiltrate to a surface of the cathode if the dimensions of the apertures are too great. If the dimensions of the apertures are too small, it is difficult for the electrons to pass through the gate electrode.

Thus, there remains a need for providing a novel gate electrode which could restrain infiltration of the electrical potential provided by the anode and allow a great amount of electrons to pass through.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
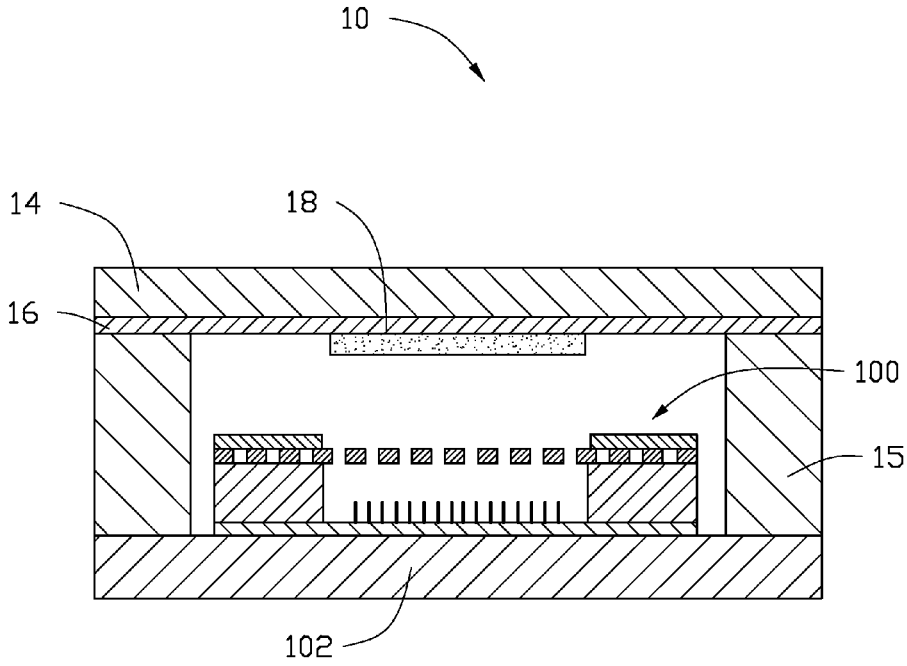
FIG. 1 is a cross-section of one embodiment of a field emission display.

According to one embodiment, a field emission display 10 as illustrated in FIG. 1 comprises an anode substrate 14, an anode 16, a plurality of spacers 15, a fluorescent layer 18, a field emission device 100, and an insulating substrate 102. The insulating substrate 102, the anode substrate 14, and the spacers 15 cooperatively define a cavity. The field emission device 100, the anode 16, and the fluorescent layer 18 are disposed in the cavity. The fluorescent layer 18 is disposed on a surface of the anode 16, and the anode 16 is disposed on a surface of the anode substrate 14.

More specifically, the field emission device 100 generates a plurality of electrons (not shown), and the anode 16 provides an electrical potential to accelerate the electrons to bombard the fluorescent layer 18 for luminance. The insulating substrate 102 can be glass, porcelain, silica, or any combination thereof. The anode substrate 14 can be a transparent substrate. In one embodiment, the insulating substrate 102 and the anode substrate 14 are glass. The anode 16 can be an indium tin oxide (ITO) film or an aluminiferous film.

Figure 2:
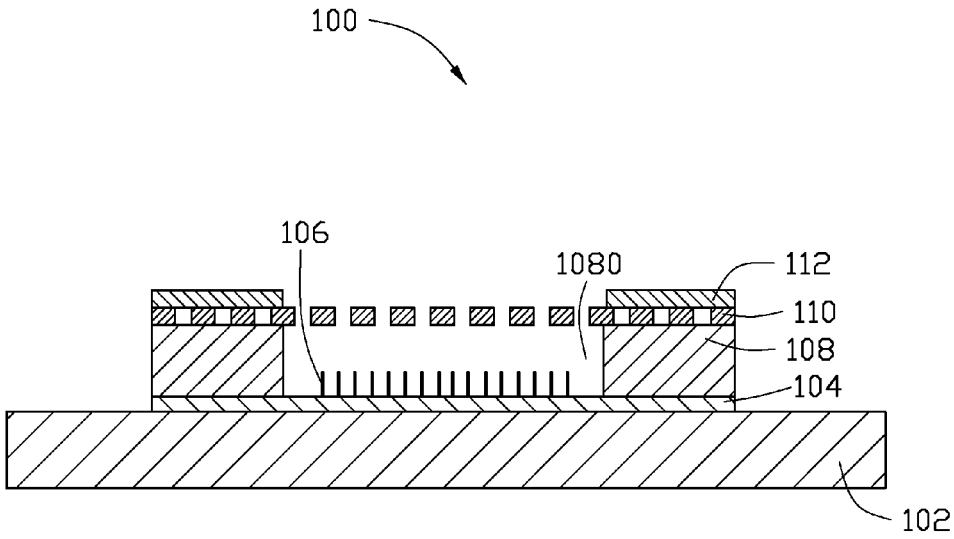
FIG. 2 is a cross-section of one embodiment of a field emission device of the field emission display shown in FIG. 1.

FIG. 2 is a cross-section of an embodiment of the field emission device 100 of the field emission display 10 shown in FIG. 1. The field emission device 100 is disposed on a surface of the insulating substrate 102, and comprises a cathode 104, an emitting layer 106, a dielectric layer 108, a metal gate electrode 110, and a fixed element 112.

The dielectric layer 108 defines a groove 1080. Thus, a part of the surface of the cathode 104 can be exposed by the groove 1080. The emitting layer 106 is disposed on the exposed surface of the cathode 104, and electrically connected to the cathode 104. The metal gate electrode 110 is sandwiched between the dielectric layer 108 and the fixed element 112. Thus, the metal gate electrode 110 is disposed corresponding to the cathode 104, and covers the groove 1080.

A shape of the insulating substrate 102 can be circular, square, or rectangular. In one embodiment, the insulating substrate 102 is a square glass substrate with sides of about 10 millimeters and a thickness of about 1 millimeter. The cathode 104 can be metal, alloy, ITO, conductive material, or any combination thereof. In one embodiment, the cathode 104 is an aluminiferous film with a thickness of about 20 micrometers.

The dielectric layer 108 can be resin, glass, porcelain, oxide, or any combination thereof. The oxide can be silica, aluminum oxide ($Al_2O_3$), or bismuth oxide. The dielectric layer 108 can be disposed on a surface of the cathode 104 or a surface of the insulating substrate 102. In one embodiment, the dielectric layer 108 is disposed on the surface of the cathode 104.

The emitting layer 106 comprises a plurality of emitters, such as carbon nanotubes, carbon nanofibers, or silicon nanolines. An ion bombardment resistance layer can be disposed on a surface of the emitting layer 106 to improve stability and the life. The ion bombardment resistance layer can be zirconium carbide, Hafnium carbide, Lanthanum hexaboride, or any combination thereof. In one embodiment, there is no ion bombardment resistance layer disposed on the emitting layer 106 which comprises a plurality of carbon nanotubes.

The fixed element 112 is an insulating layer which defines a groove corresponding to the groove 1080 of the dielectric layer 108. Thus, the metal gate electrode 110 can be exposed.

Figure 3:
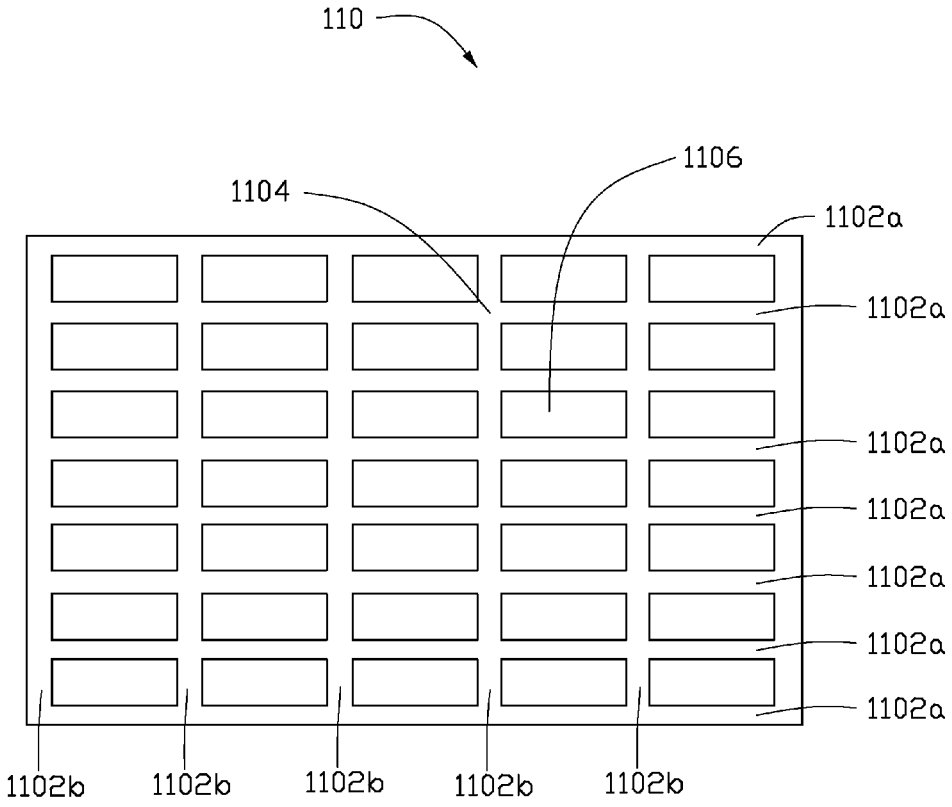
FIGS. 3, 4, and 5 show schematic views of different embodiments of the metal gate electrodes of the field emission device shown in FIG. 2.
Figure 4:
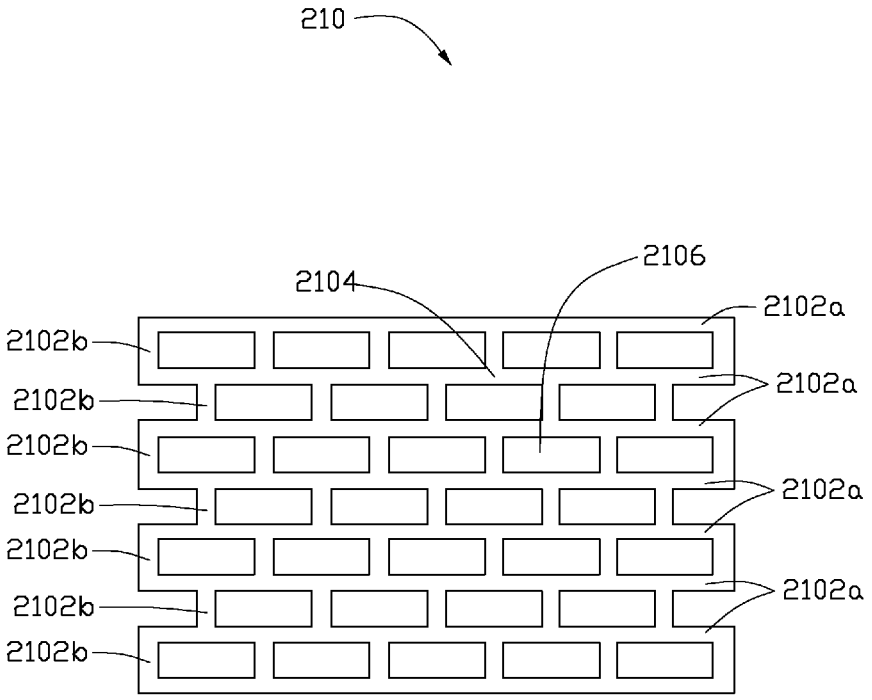
Figure 5:
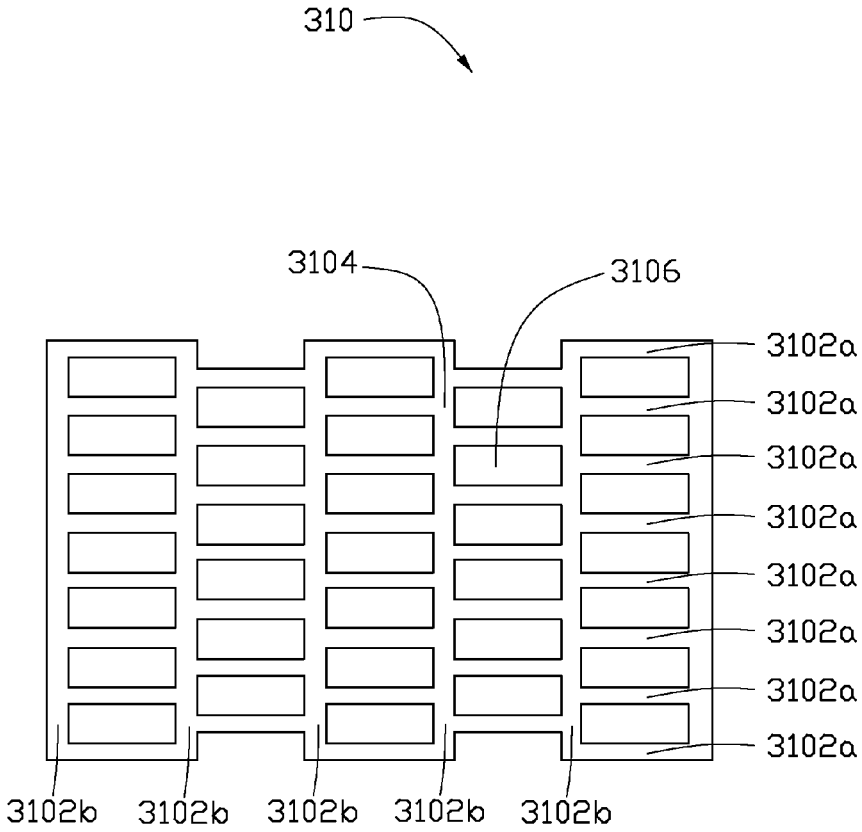

FIGS. 3, 4, and 5 respectively show schematic views of different embodiments of the metal gate electrodes 110, 210, 310 of the field emission device 100 shown in FIG. 2. In one embodiment, the field emission device 100 comprises the metal gate electrode 110. However, the metal gate electrode 110 can be replaced by other embodiments of the metal gate electrodes 210, 310.

According to one embodiment, the metal gate electrode 110 as illustrated in FIG. 3 comprises a plurality of first metal strips 1102*a* and a plurality of second metal strips 1102*b*. The first metal strips 1102*a* are arranged substantially along a first direction in parallel. The second metal strips 1102*b* are arranged substantially along a second direction substantially perpendicular to the first direction, in parallel.

More specifically, the first metal strips 1102*a* and the second metal strips 1102*b* are connected to each other to form a plurality of nodes 1104 and define a plurality of substantially rectangular apertures 1106 arranged in columns and rows in parallel.

The first and second metal strips 1102*a*, 1102*b* can be stainless steel, molybdenum, wolfram, or any combination thereof. A thickness of each of the first and second metal strips 1102*a*, 1102*b* is equal to or greater than 10 micrometers. In one embodiment, the thickness of each of the first and second metal strips 1102*a*, 1102*b* is in a range from about 30 micrometers to about 60 micrometers. Thus, a distance between two adjoining rectangular apertures 1106 is equal to or greater than 10 micrometers. A width of each of the first and second metal strips 1102*a*, 1102*b* is equal to or greater than 10 micrometers. In one embodiment, the width of each of the first and second metal strips 1102*a*, 1102*b* is in a range from about 40 micrometers to about 600 micrometers.

Furthermore, a length of each of the rectangular apertures 1106 is in a range from about 300 micrometers to about 600 micrometers, and a width of each of the same is in a range from about 50 micrometers to about 300 micrometers. In one embodiment, a width of each of the rectangular apertures 1106 is equal to or smaller than 100 micrometers, such that the electrical potential generated by the anode 16 is efficiently restrained. A total open area of the metal gate electrode 110 can be adjusted by changing the length of each of the rectangular apertures 1106. In one embodiment, an aspect ratio of the length to the width of each of the rectangular apertures 1106 is equal to or greater than 3:1. Thus, ea ratio of the open area of the metal gate electrode 110 to a total area of the metal gate electrode 110 is equal to or greater than 50%.

According to another embodiment, the metal gate electrode 210 as illustrated in FIG. 4 comprises a plurality of first metal strips 2102*a* and a plurality of second metal strips 2102*b*. The first metal strips 2102*a* are arranged substantially along one direction, such as a first direction, in parallel. The second metal strips 2102*b* are arranged substantially along another direction, such as a second direction substantially perpendicular to the first direction, in parallel.

More specifically, the first metal strips 2102*a* and the second metal strips 2102*b* are connected to each other to form a plurality of nodes 2104 and define a plurality of rectangular apertures 2106. The rectangular apertures 2106 are arranged as a plurality of columns and a plurality of rows in interlace or a plurality of staggered columns and a plurality of staggered rows.

According to still another embodiment, the metal gate electrode 310 as illustrated in FIG. 5 comprises a plurality of first metal strips 3102*a* and a plurality of second metal strips 3102*b*. The first metal strips 3102*a* are arranged substantially along one direction, such as a first direction, in parallel. The second metal strips 3102*b* are arranged substantially along another direction, such as a second direction substantially perpendicular to the first direction, in parallel.

More specifically, the first metal strips 3102*a* and the second metal strips 3102*b* are connected to each other to form a plurality of nodes 3104 and define a plurality of rectangular apertures 3106. The rectangular apertures 3106 are arranged as a plurality of columns and a plurality of rows in interlace or a plurality of columns and a plurality of staggered rows.

Accordingly, the present disclosure is capable of providing an emission device with a metal gate electrode which has a plurality of rectangular apertures. Furthermore, an aspect ratio of each of the rectangular apertures can be greater than 3:1, such that a total open area of the metal gate electrode can be greater than 50%. Thus, an electrical potential provided by an anode can be efficiently restrained, and a large amount of electrons can pass through by the metal gate electrode.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

What is claimed is:

1. A field emission display, comprising:

an anode substrate;

an anode disposed on a surface of the anode substrate;

a plurality of spacers;

a fluorescent layer;

an insulating substrate; and a field emission device comprising a fixed element, a dielectric layer, an emitting layer, an cathode and a metal gate electrode, wherein the insulating substrate, the anode substrate, and the plurality of spacers cooperatively define a cavity, the field emission device, the anode, and the fluorescent layer are disposed in the cavity, the fluorescent layer is disposed on a surface of the anode, and the metal gate electrode comprises:

a plurality of first metal strips arranged substantially along a first direction in parallel; and a plurality of second metal strips arranged substantially along a second direction in parallel, wherein the first direction is substantially perpendicular to the second direction, and the plurality of first metal strips are connected to the plurality of second metal strips to define a plurality of rectangular apertures through which electrons are capable of passing, a first group of the plurality of rectangular apertures are suspended above the electron emitter, and a second group of the plurality of rectangular apertures are sandwiched between the fixed element and the dielectric layer; and at least one of the second group of the plurality of rectangular apertures is fully covered by the fixed element and the dielectric layer, wherein a portion of the anode is sandwiched between the anode substrate and the plurality of spacers, and wherein the portion of the anode is in direct with the anode substrate and the plurality of spacers.

2. The field emission display as claimed in claim 1, wherein the fixed element is an insulating layer defining a groove and part of the metal gate electrode is exposed by the groove.

3. The field emission display as claimed in claim 1, wherein a length of each of the plurality of rectangular apertures is in a range from about 300 micrometers to about 600 micrometers.

4. The field emission display as claimed in claim 1, wherein a width of each of the plurality of rectangular apertures is in a range from about 50 micrometers to about 300 micrometers.

5. The field emission display as claimed in claim 4, wherein a width of each of the rectangular apertures is greater than 50 micrometers and less than or equal to 100 micrometers.

6. The field emission display as claimed in claim 1, wherein an aspect ratio of a length to a width of each of the plurality of rectangular apertures is equal to or greater than 3:1.

7. The field emission display as claimed in claim 1, wherein a ratio of an open area of the metal gate electrode to a total area of the metal gate electrode is equal to or greater than 50%.

8. The field emission display as claimed in claim 1, wherein a thickness of each of the plurality of first metal strips and a thickness of each the plurality of second metal strips are equal to or greater than 10 micrometers.

9. The field emission display as claimed in claim 1, wherein a width of each of the plurality of first metal strips and a width of each the plurality of second metal strips are equal to or greater than 10 micrometers.

10. The field emission display as claimed in claim 1, wherein the plurality of first metal strips and the plurality of second metal strips are selected from the group consisting of stainless steel, molybdenum, wolfram, and any combination thereof

11. The field emission display as claimed in claim 1, wherein the rectangular apertures of each column are arranged along a first direction, and one rectangular aperture of a first column overlaps part of two neighboring rectangular apertures of a second column which is neighboring the first column along a second direction perpendicular to the first direction.

12. The field emission display as claimed in claim 1, wherein the rectangular apertures of each row are arranged along a third direction, one rectangular aperture of a first row overlaps part of two neighboring rectangular apertures of a second row which is neighboring the first row along a fourth direction perpendicular to the third direction.

13. The field emission display as claimed in claim 1, wherein the plurality of rectangular apertures uniformly distributes on an entire surface of the metal gate electrode.

14. The field emission display as claimed in claim 1, wherein at least three of the second group of the plurality of rectangular apertures are fully covered by the fixed element and the dielectric layer.

15. The field emission display as claimed in claim 1, wherein the cathode is located on the insulating substrate, and the dielectric layer is located on and in direct contact with a surface of the cathode.

* * * * *